United States Patent [19]

Campbell et al.

[11] 4,121,071

[45] Oct. 17, 1978

[54] ELECTRIC SWITCH

[75] Inventors: Dudley H. Campbell; Arthur W. Overton, both of Raleigh, N.C.

[73] Assignee: Stackpole Components Company, Raleigh, N.C.

[21] Appl. No.: 769,556

[22] Filed: Feb. 17, 1977

[51] Int. Cl.[2] ..... H01H 13/28

[52] U.S. Cl. ..... 200/67 G; 200/315; 200/339; 200/67 A

[58] Field of Search ..... 200/315, 339, 67 A, 200/67 G, 68, 303, 243, 247, 6 BB, 6 B

[56] References Cited

U.S. PATENT DOCUMENTS

| | | | |
|---|---|---|---|
| 2,840,657 | 6/1958 | Roeser | 200/303 X |
| 3,163,741 | 12/1964 | Bury | 200/303 X |
| 3,165,604 | 1/1965 | Sorenson | 200/67 G |
| 3,196,220 | 4/1965 | Brown | 200/67 G X |
| 3,403,237 | 9/1968 | Wysong | 200/339 X |
| 3,427,418 | 2/1969 | Norden | 200/339 X |
| 3,535,478 | 10/1970 | Lewis | 200/68 X |
| 3,878,344 | 4/1975 | Lockard | 200/6 BB X |
| 3,944,768 | 3/1976 | Aryamane et al. | 200/67 G |
| 3,983,341 | 9/1976 | Stanish | 200/303 |

FOREIGN PATENT DOCUMENTS

| | | | |
|---|---|---|---|
| 1,147,714 | 4/1969 | United Kingdom | 200/6 BB |

*Primary Examiner*—J. V. Truhe
*Assistant Examiner*—Mark Paschall
*Attorney, Agent, or Firm*—Brown, Murray, Flick & Peckham

[57] ABSTRACT

A switch housing having a separate base attached to one end includes an electric end contact secured to each end of the base inside the housing, and central electric terminal means secured to the central part of the base between the end contacts. An elongated bridging contact engages the central terminal means and has end portions beside rigid dielectric members projecting from the base adjacent the end contacts for restricted lateral movement of the bridging contact. The end contacts have projections overlying the end portions of the bridging contact, and the base and all of the contacts and terminals together form a base unit in which the bridging contact is confined between the base and the overlying portions of the end contacts before the base is secured to the rest of the switch housing. Manually operable actuating means engage the bridging contact for rocking it on the central terminal means to electrically connect the latter with the overlying portions of either of the overlying contacts.

2 Claims, 11 Drawing Figures

ELECTRIC SWITCH

Switches in which an elongated bridging contact can be rocked on a central terminal projecting from a base so that one end or the other of the bridging contact will be moved into engagement with an end contact on the base are well known. However, in the case of a separate base, the bridging contact generally is not put in place until after the base has been attached to the rest of the switch housing, but this is difficult to do because the bridging contact has to be located in the bottom of the switch housing. The same problem exists when the base is integral with the rest of the switch housing. If a separate base is used and it is attempted to assemble the bridging contact with the base before being attached to the housing, extreme care must be used to prevent the bridging contact from slipping out of position before or during attachment of the base to the rest of the housing.

It is among the objects of this invention to provide a switch having a separate base, in which the bridging contact is placed in operative position before the base is attached to the rest of the switch housing, and in which the bridging contact cannot escape from the assembly of fixed contacts and base before the base is attached to the housing. Another object is to provide a switch having a bridging contact for connecting either of two end contacts with either one of a pair of live central terminals and for connecting the central terminals with each other when the bridging contact is out of engagement with the end contacts.

The invention is illustrated in the accompanying drawings, in which

Figure 1:
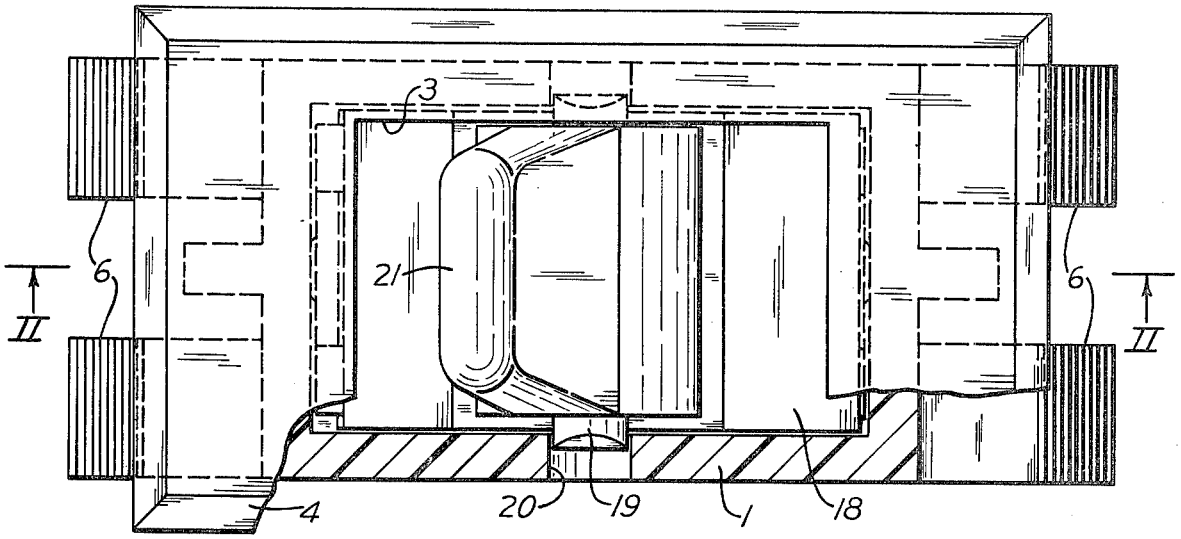
FIG. 1 is a plan view of the switch partly in section.

Referring to FIGS. 1 to 5 of the drawings, a switch housing has side walls 1, a separate base 2 attached to its lower end and an opening 3 in its top. The top of the housing may be provided with a surrounding laterally extending flange 4 to seat against a panel through which the housing extends, and the opposite ends of the housing may be provided with resilient inclined wings 6, the free ends of which are sprung inwardly toward the adjacent walls of the housing when the housing is inserted in the panel, the free ends being serrated to grip the wall of the panel opening to lock the switch in the panel in a well-known manner.

The insulating base 1 of the switch housing carries contacts and terminals that are applied to it before it is attached to the rest of the housing. There is an end contact 7 inside the housing at each end of the base, and a central terminal 8 midway between them extending through the base. Each of the contacts also extends through the base and is provided with an integral terminal 9 which, like terminal 8, can be inserted in a slot in a supporting panel or inserted in a printed circuit board. The contacts and the upper part of the central terminal are wider than the base slots through which they extend, and the terminals are staked to lock the contacts and terminals in the base.

Rockably mounted on the central terminal 8 is the central portion of an elongated bridging contact 11 in the form of a rigid metal strip. The upper end of the central terminal is provided with a rectangular recess 12 shown in FIG. 5, which receives the bridging contact that is provided with notches 13 (FIG. 4) that receive the portions of the central terminal at the opposite ends of recess 12. These notches are wide enough to permit the bridging contact to be rocked back and forth on the central terminal.

Figure 2:
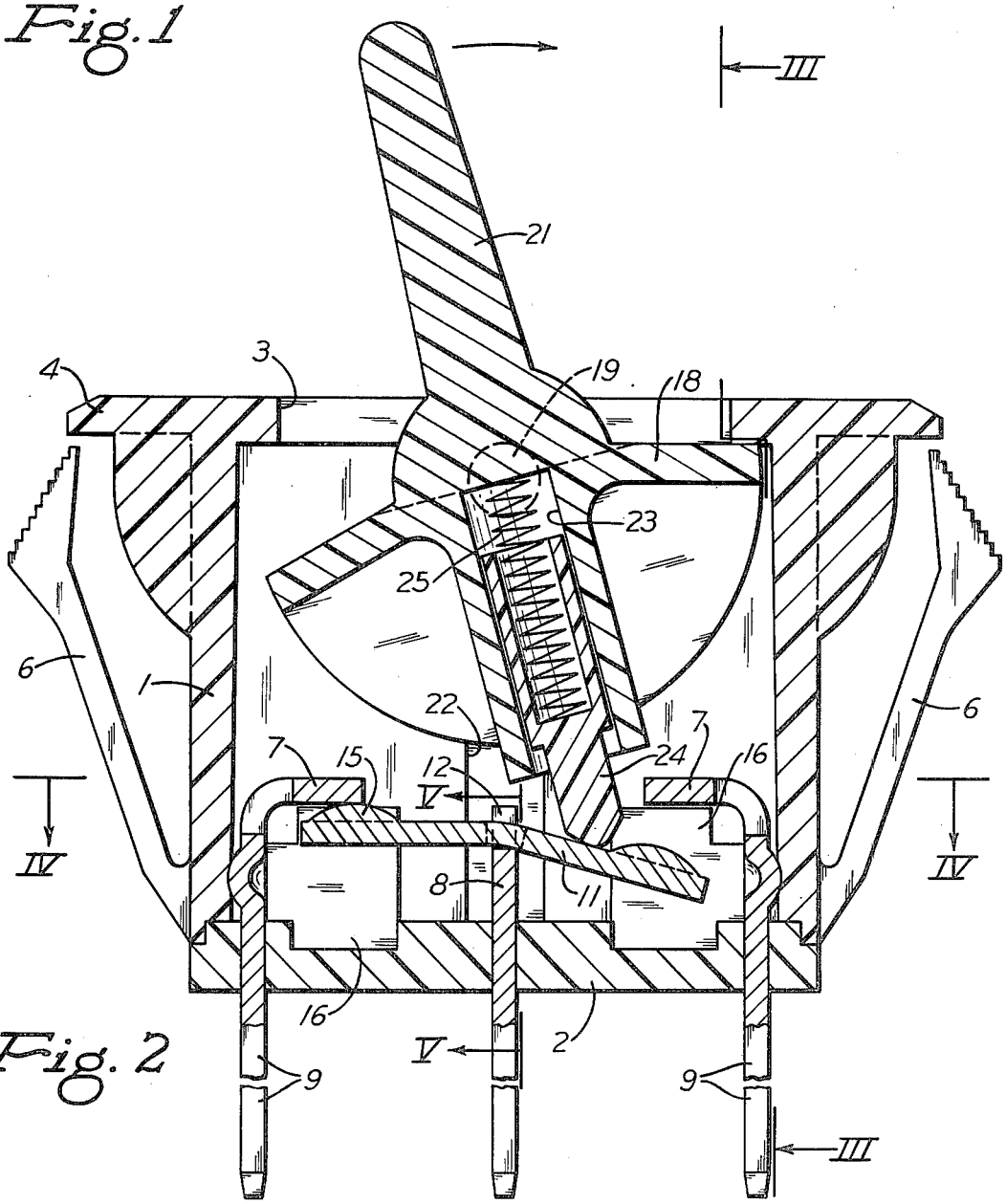
FIG. 2 is a vertical section taken on the line II—II of FIG. 1.
Figure 3:
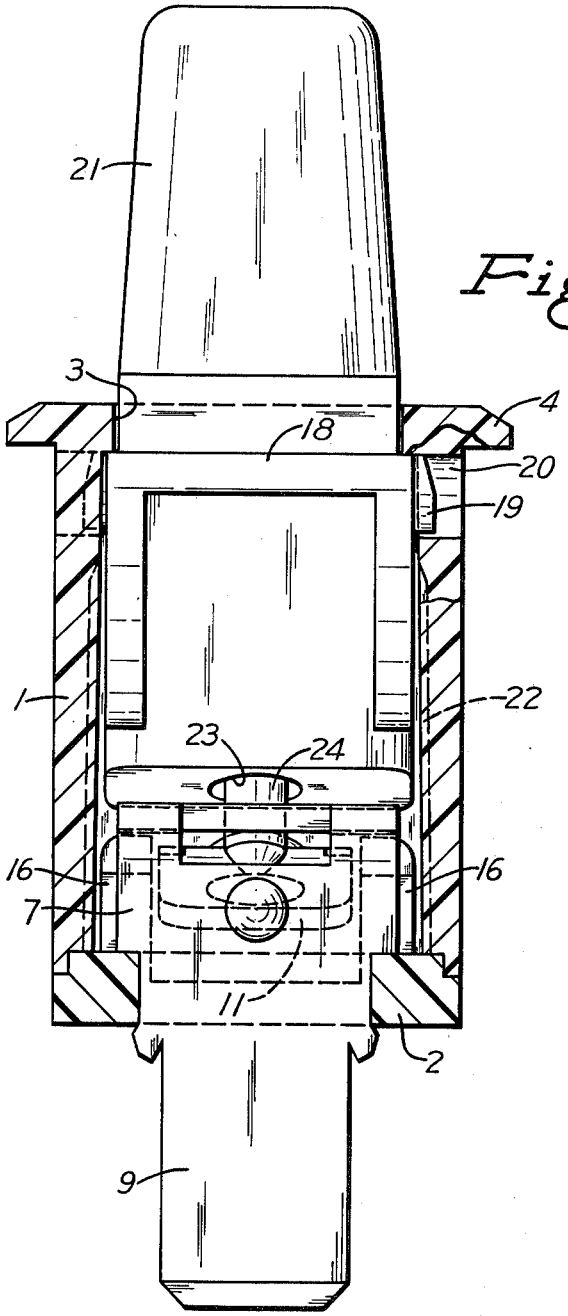
FIG. 3 is a vertical section taken on the line III—III of FIG. 2.
Figure 5:
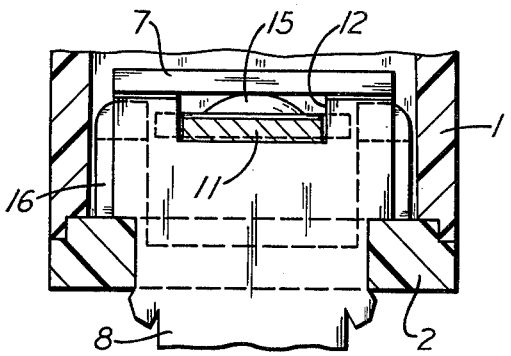
FIG. 5 is a fragmentary vertical section taken on the line V—V of FIG. 2.
Figure 4:
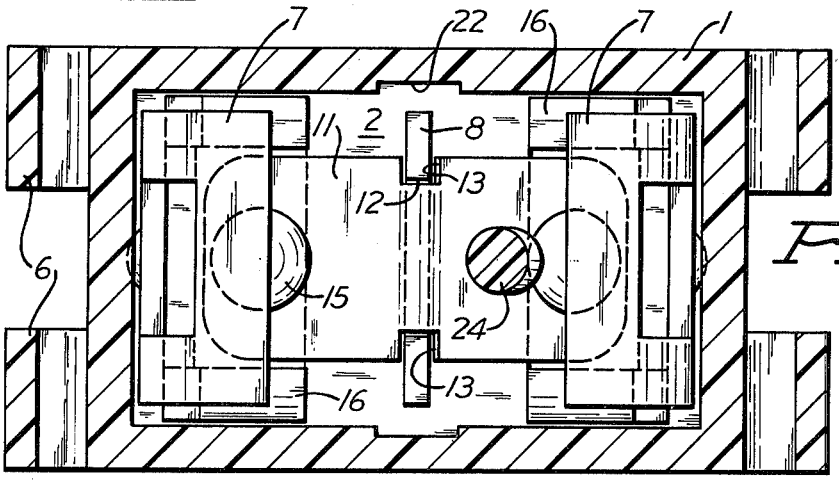
FIG. 4 is a horizontal section taken on the line IV—IV of FIG. 2.

In accordance with this invention the upper end portions of the two end contacts 7 are bent inwardly toward each other so that each overlies the adjacent end portion of the bridging contact. On each end of the bridging contact there may be mounted an electric contact member 15 for engaging the overlying end contact, but the arrangement is such that when one end contact is engaged by a contact member, the other contact member will be spaced from the other end contact as shown in FIG. 2. Projecting upwardly from each end of the base is a pair of integral members 16, shown in FIGS. 2 and 4, between which the adjacent end of the bridging contact is loosely confined so that it cannot move laterally. The result is that when the three contacts and their terminals have been assembled with the base, the bridging contact is confined between the overlying portions of the end contacts and the base and cannot escape from that location. This base unit, therefore, can be handled freely attachment to the rest of the switch housing, without any danger of the loose bridging contact becoming separated from the unit.

In order to rock the bridging contact to connect central terminal 8 with either one of the end contacts, manually operable actuating means are mounted in the housing above the contacts. The actuating means show include a rocker body 18 provided at its opposite sides with trunnions 19 that project into openings 20 (FIG. 3) in the sides of the housing directly below its top flange. Extending upwardly through the opening in the top of the housing is an operating lever 21 for rocking the rocker body. To facilitate assembly of the housing actuating means, the inner walls of the sides of the housing are provided with grooves 22 extending upwardly to points close to the holes for the trunnions, and the ends of the trunnions are provided with inclined surfaces that engage the housing at the upper ends of the grooves and spring its side walls apart far enough to permit the trunnions to snap into the holes when the actuating means is pushed up into the housing. As shown in FIG. 2, the central portion of the rocker body is provided with an upwardly extending bore 23, in which a plunger 24 is slidably mounted. The upper portion of the plunger has a downwardly extending bore in which there is a coil spring 25 that urges it downwardly. The spherical lower end of the plunger engages the bridging contact and presses downwardly on it.

Assuming that the plunger is pressing downwardly on one end of the bridging contact as shown in FIG. 2, the opposite end of that contact will be in engagement with the overlying end contact and a circuit will be established between it and the central terminal 8. If the rocker lever is now swung to its opposite position, the plunger will slide along the bridging contact toward and past the central terminal and then will rock the bridging contact far enough to cause its previously disengaged contact member to engage the overlying end contact.

Figure 6:
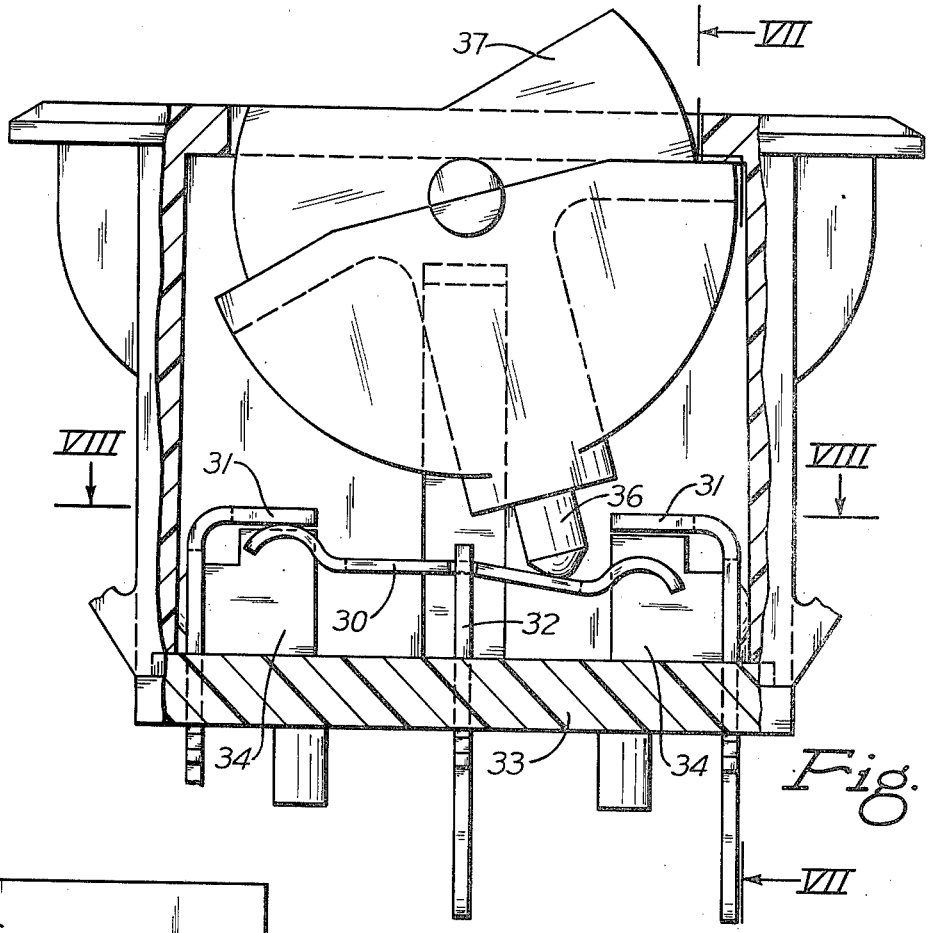
FIG. 6 is a fragmentary side view, partly in section, of a modification.
Figure 7:
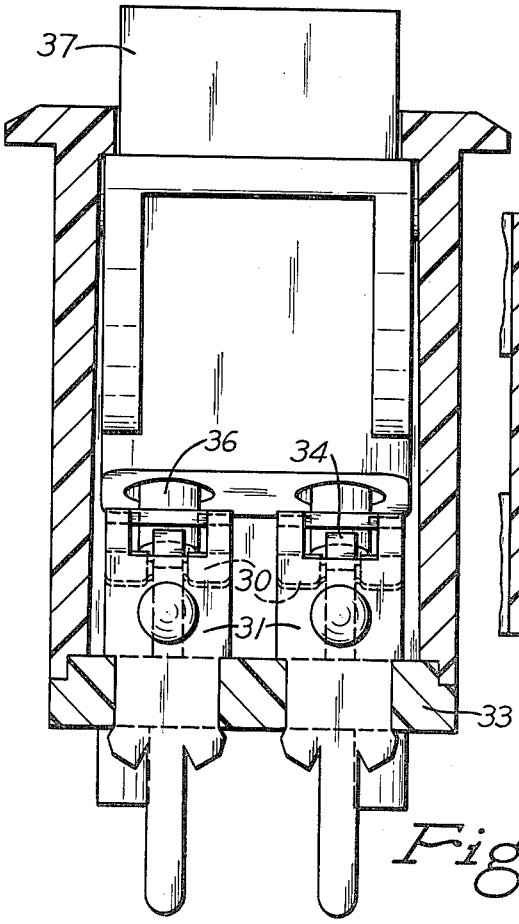
FIG. 7 is a vertical section taken on the line VII—VII of FIG. 6.
Figure 8:
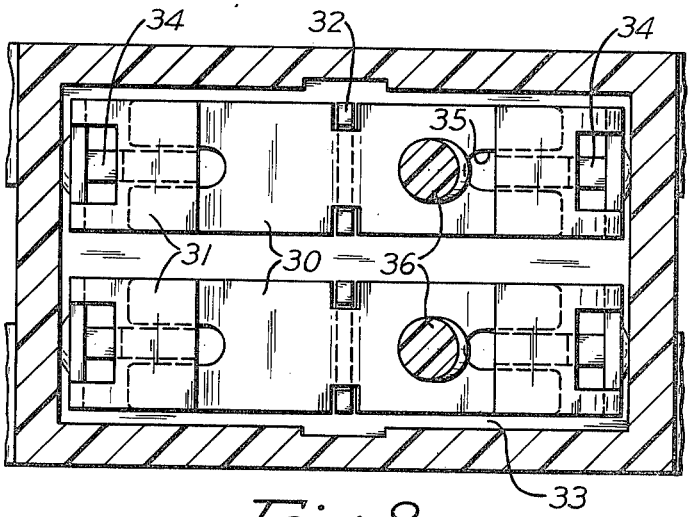
FIG. 8 is a horizontal section taken on the line VIII—VIII of FIG. 6.

In the modification shown in FIGS. 6, 7 and 8, the bridging contact 30 has convex end portions for engaging the overlying portions of the end contacts 31. The central portion of the bridging contact is mounted on a central terminal 32 mounted in the housing base 33 in the same way as in the first embodiment. On the other hand, instead of having two projections from the base beside each end of the bridging contact, there is only one such projection 34 at each end and that extends up through a longitudinal slot 35 (FIG. 8) in the bridging contact. In other words, the ends of the bridging contact straddle the two projections, which prevent the contact from moving laterally. This embodiment of the invention also shows how two switches can be mounted side by side by duplicating the fixed contacts and bridging contacts and spring-pressed plungers 36. The bridging contacts are held or trapped in place by the fixed contacts and the base projections. The manually operable actuating means may be constructed the same as that first described or, instead of having a lever projecting from the housing, it may have an integral rocker 37 that has one projecting end. When that end is depressed, the rocker will be rocked on its axis and project its opposite end. Both bridging contacts are rocked together when the actuating means is operated.

Figure 9:
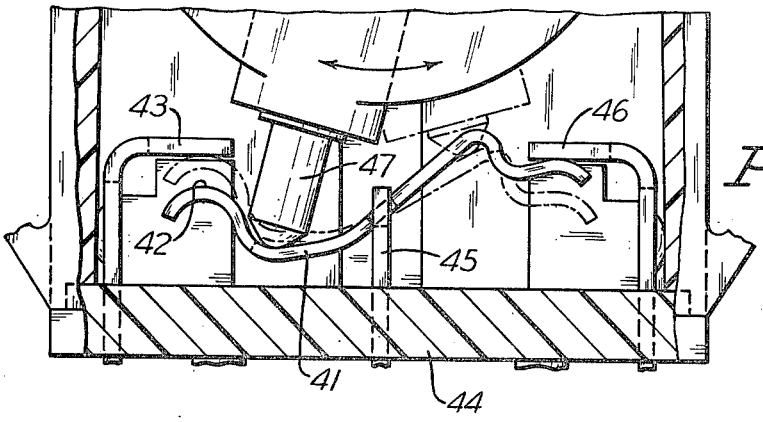
FIGS. 9 and 10 are fragmentary views, similar to FIG. 6, of two further modifications.

In a further embodiment of the invention shown in FIG. 9, the switch may be made essentially the same as the second embodiment, except that the shape of the bridging contact 41 is changed. One end of the contact is bent to form a convex portion 42 for engaging the overlying portion of an end contact 43 as shown in dotted lines. When in that position, the bridging contact extends downwardly toward the housing base 44 and then more or less parallel to the base as it approaches the central terminal 45. The bridging contact then slopes upwardly past the central terminal at a fairly steep angle to a point nearly on a level with the top of the other end contact 46. Then the bridging contact extends downwardly a short distance and then outwardly beneath the top of the end contact. As long as the actuating means for the switch is held in the dotted-line position, wherein the spring-pressed plunger 47 engages the bridging contact near its highest point, the opposite end of the bridging contact will engage end contact 43. However, when the actuating means is released, the expanding coil spring inside the plunger will force the plunger downwardly along the sloping surface of the bridging contact, and as soon as the plunger passes the central terminal, it will cause the bridging contact to rock to its full-line position so that the opposite end of that contact will engage end contact 46. Thus, this particular switch is closed in one direction by manual operation and is closed in the opposite direction by spring force on the plunger.

Figure 10:
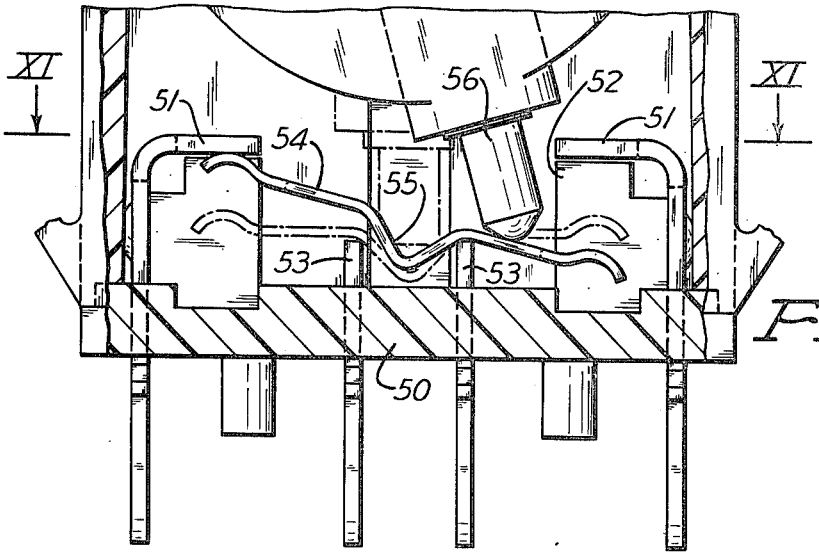
Figure 11:
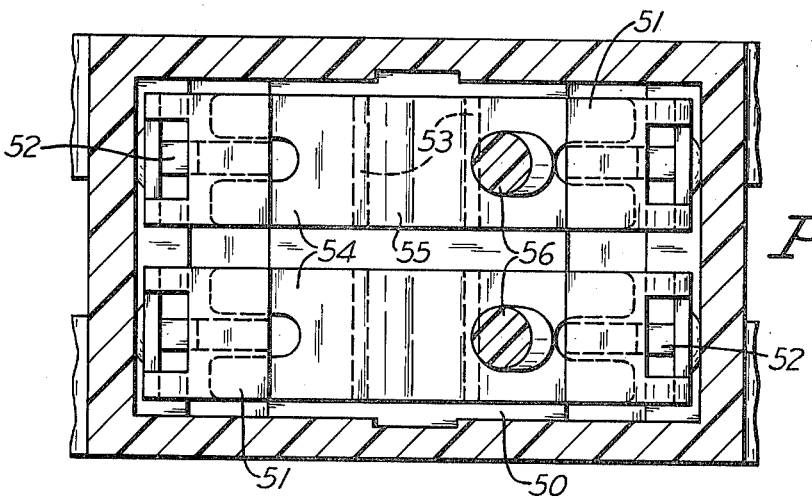
FIG. 11 is a horizontal section taken on the line XI—XI of FIG. 10.

In still another modification shown in FIGS. 10 and 11, the housing base 50 is provided with end contacts 51 and base projections 52 like those shown in the other forms of the invention, but instead of there being a single central terminal, there are two central terminals 53 that are spaced lengthwise of the base. These two terminals project only a short distance from the base as compared with the end contacts. Another difference is that the bridging contact 54, the slotted ends of which straddle the base projections, has a central portion that is bent downwardly between the two center terminals. Preferably, this central portion is V-shape to form a downwardly tapered recess 55 in the top of the bridging contact.

The actuating means for this switch may be the same as in the other forms of the switch. When the actuating means is in one of its extreme positions, the spring-pressed plunger 56 bears upon the bridging member between one of the center terminals and the adjacent end contact. This swings the opposite end of the bridging member up against the overlying end contact at the opposite end of the base, so an electric circuit is closed between that end contact and the center terminal farthest from it, the bridging contact being out of engagement with the other center terminal. When the actuating means is shifted to its other extreme position, the previously inactive center terminal is electrically connected by the bridging contact with the end contact that was not in circuit before. A feature of this particular switch is that the actuating means can be moved into a central or intermediate position as shown in dotted lines in FIG. 10, in which the plunger will extend down into the recess in the center of the bridging contact and hold the latter in engagement with both of the center terminals simultaneously. At such a time both ends of the bridging contact are spaced from the end contacts, so the circuit is closed only between the two center terminals, both of which are live. It will be seen that with this switch three different circuits can be closed.

Instead of actuating these switches by swinging pivoted rockers back and forth, each spring-pressed plunger could be carried by a manually operable slide that can be moved back and forth in a straight line in the switch housing. Movement of the slide will cause the plunger to slide along the bridging contact and rock it on its central support in the same manner as described herein.

According to the provisions of the patent statutes, we have explained the principle of our invention and have illustrated and described what we now consider to represent its best embodiment. However, we desire to have it understood that, within the scope of the appended claims, the invention may be practiced otherwise than as specifically illustrated and described.

We claim:

1. An electric switch comprising a housing having a separate base attached to one end and an opening at the opposite end, an electric end contact secured to each end of the base inside the housing, central electric terminal means secured to the central part of the base between said end contacts and projecting from the housing, terminals carried by the base outside of the housing and connected to said end contacts, a rigid metal strip forming a bridging contact having a central portion resting on the inner end of said central terminal means and rockable thereon, the end contacts having portions overlying the end portions of the bridging contact, said base and all of the contacts and terminals forming together a base unit in which the bridging contact cannot escape from between said base and said overlying portions of the end contacts before the base is secured to the rest of the switch housing, and manually operable actuating means extending down through said housing opening and engaging the upper surface of the bridging contact for rocking that contact on said central terminal means to electrically connect the latter with the overlying portion of either of said end contacts, at least one end portion of the bridging contact being provided with a longitudinal slot extending inwardly from the end of that contact, a rigid dielectric member extending into said slot from said base to restrict lateral movement of the bridging contact.

2. An electric switch comprising a housing having a separate base attached to one end and an opening at the opposite end, an electric end contact secured to each end of the base inside the housing, central electric terminal means secured to the central part of the base between said end contacts and projecting from the housing, terminals carried by the base outside of the housing and connected to said end contacts, a rigid metal strip forming a bridging contact having a central portion resting on the inner end of said central terminal means and rockable thereon, the end contacts having portions overlying the end portions of the bridging contact, said base and all of the contacts and terminals forming together a base unit in which the bridging contact cannot escape from between said base and said overlying portions of the end contacts before the base is secured to the rest of the switch housing, and manually operable actuating means extending down through said housing opening and engaging the bridging contact for rocking it on said central terminal means to electrically connect the latter with the overlying portion of either of said end contacts, said actuating means including an actuating element movably mounted in the switch housing, and a spring-pressed member carried by said element and bearing against the upper surface of the bridging contact, the bridging contact having a steeply inclined portion at one side of said central terminal means engaged by said member when the bridging contact is engaging the end contact at the opposite side of the central terminal means, said inclined portion sloping down toward the central terminal means, whereby when said actuating element is released said spring-pressed member will slide along said inclined portion of the bridging contact toward the opposite end of that contact to rock it into engagement with the other end contact.

* * * * *